United States Patent [19]

Kaschura

[11] 4,306,361

[45] Dec. 22, 1981

[54] SHOE OF NATURAL SHAPE

[75] Inventor: Paul Kaschura, Hardegsen, Fed. Rep. of Germany

[73] Assignee: Wolverine World Wide, Inc., Rockford, Mich.

[21] Appl. No.: 96,191

[22] Filed: Nov. 20, 1979

[30] Foreign Application Priority Data

Apr. 9, 1979 [DE] Fed. Rep. of Germany ..... 2914309

[51] Int. Cl.[3] ..... A43B 7/16; A43D 0/00

[52] U.S. Cl. ..... 36/92; 12/146 L

[58] Field of Search ..... 36/11, 14, 9 R, 11.5, 36/91, 92; 12/142 RS, 146 L

[56] References Cited

U.S. PATENT DOCUMENTS

| | | | |
|---|---|---|---|
| 62,907 | 3/1867 | Tolhurst | 36/92 |
| 109,438 | 11/1870 | McComber | 36/92 |
| 134,252 | 12/1872 | Chandler et al. | 36/92 |
| 3,147,558 | 9/1964 | Bingham | 36/14 |
| 3,217,345 | 11/1965 | Snitzer | 36/14 |
| 3,325,919 | 6/1967 | Robinson | 36/92 |
| 3,423,854 | 1/1969 | Snow | 36/11 |
| 3,605,290 | 9/1971 | Eder et al. | 36/14 |
| 3,613,272 | 10/1971 | Fukuoka | 36/11.5 |
| 3,863,272 | 2/1975 | Guille | 36/9 R |
| 3,863,366 | 2/1975 | Auberry et al. | 36/14 |
| 3,964,181 | 6/1976 | Holcombe | 36/91 |

*Primary Examiner*—Patrick D. Lawson

*Attorney, Agent, or Firm*—Price, Heneveld, Huizenga and Cooper

[57] ABSTRACT

A shoe of natural shape having a flexible material forming the upper part of the shoe, replacing the insole, and extending all over the sole surface to comprise a stocking-like part which extends over the last to envelop the foot on all sides, there being a recess in the heel portion of the footbed with a bearing surface rising from this recess on a forward rising angle to the arch, the bearing surface being cup-shaped with a peripheral edge connected to the stocking-like part.

5 Claims, 7 Drawing Figures

SHOE OF NATURAL SHAPE

BACKGROUND OF THE INVENTION

The invention relates to a shoe of natural shape, i.e. a street shoe without an insole of the kind of a moccasin made on a last of the correct shape, such as it is approximately described in the German Gebrauchsmuster No. 7,216,324. Such shoes represent a so-called shoe of natural shape, permitting orthopedically correct walking whereby the body weight is distributed upon the entire skeleton of the foot in about the same way as when running barefoot. A soft material, replacing the otherwise conventionally used insole, extends over the surface of the sole. The upper part of the shoe is a stocking-like part to be drawn over the last and envelope the foot from all sides. Such shoes have the inconvenience that the user has insufficient support while running in that his foot slips toward the tip or toe of the shoe, by which the shoe loses its well fitting shape after only a short period of use.

SUMMARY OF THE INVENTION

The task of the innovation is to improve the running qualities of such a shoe to enable orthopedically correct running. According to the in vention, during manufacture, a last is used in which the deepest point of the heel of the running surface of the shoe formed by the last, lies nearer to the running surface than the highest point of the arching of the joint, so that a supporting surface for the foot is formed in the shoe rising from the heel to the arching of the joint. The shoe made with such a last has a deepening or recess for the reception of the heel in the area of the heel of the footbed. The latter forms on its upper part a supporting surface of the foot, rising from the deepest point of the deepening for the heel to the arching of the joint, providing good support for walking, and preventing the foot from slipping forward in the shoe. Furthermore, the footbed is formed with the supporting surface for the foot rising from the deepening for the heel to the arching of the joint in a cup-shaped lower part of the shoe adapted to the form of the sole of the foot and forming the running sole and the heel. This footbed encompasses the stocking-like upper part of the shoe with a high drawn edge to which is is lastingly connected by adhesion to the upper part of the shoe.

The concept of the invention is capable of various embodiments, one of which is depicted in the attached drawings.

DESCRIPTION OF THE PREFERRED EMBODIMENT

Figure 1:
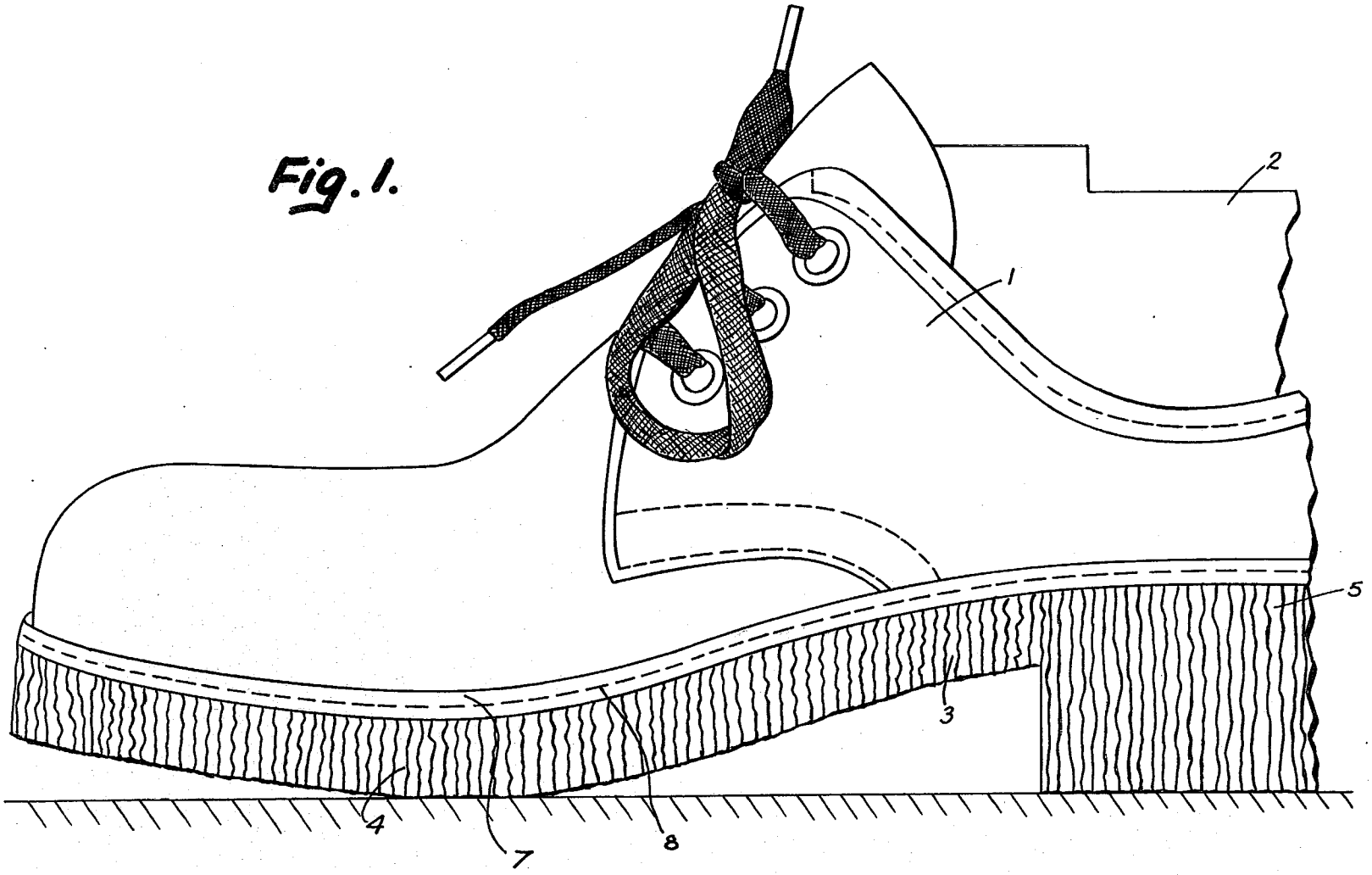
FIG. 1 depicts a side elevational view of a shoe of natural shape according to the invention.
Figure 2:
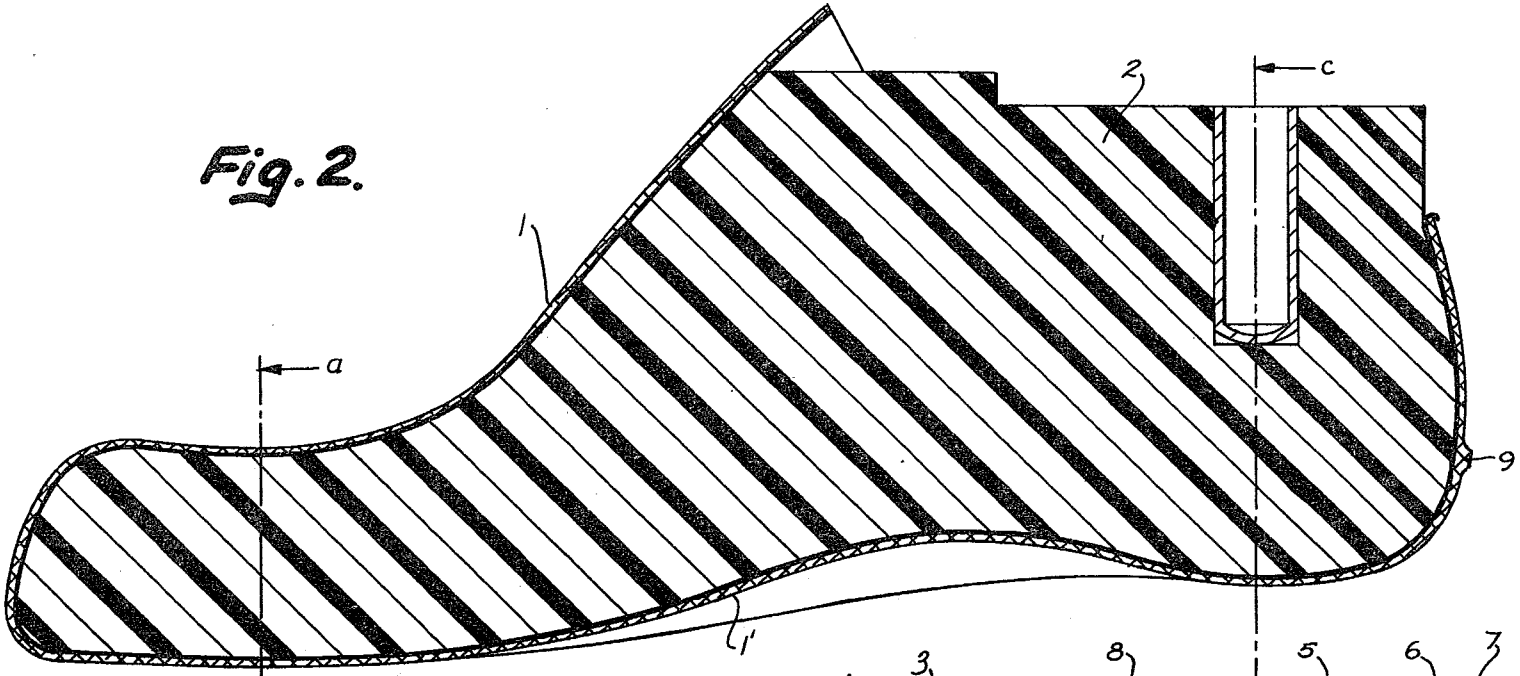
FIG. 2 is a longitudinal section through the last and upper portion of the shoe in FIG. 1.
Figure 3:
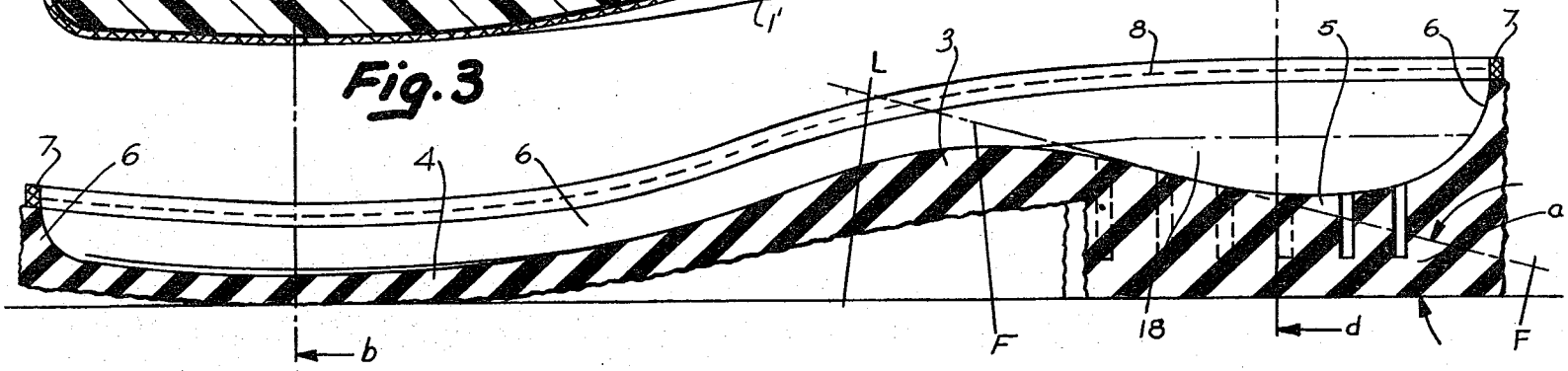
FIG. 3 is a longitudinal section through the lower part of the shoe in FIG. 1, the upper and lower parts of the shoe in FIGS. 2 and 3 being separated for clarity.

Referring to FIGS. 1–3, the stocking-like upper part 1 of the shoe formed of flexible material 1', for covering the foot sole, are shown drawn over a last 2. The seams 9 connecting the individual material cuts are directed to the outside, as depicted in FIGS. 2 and 3. It is important that last 2 used for the production of the shoe correspond closely to the natural shape of a foot. FIGS. 2 and 3 show the precise design of the last in relation to the running surface L.

Figure 4:
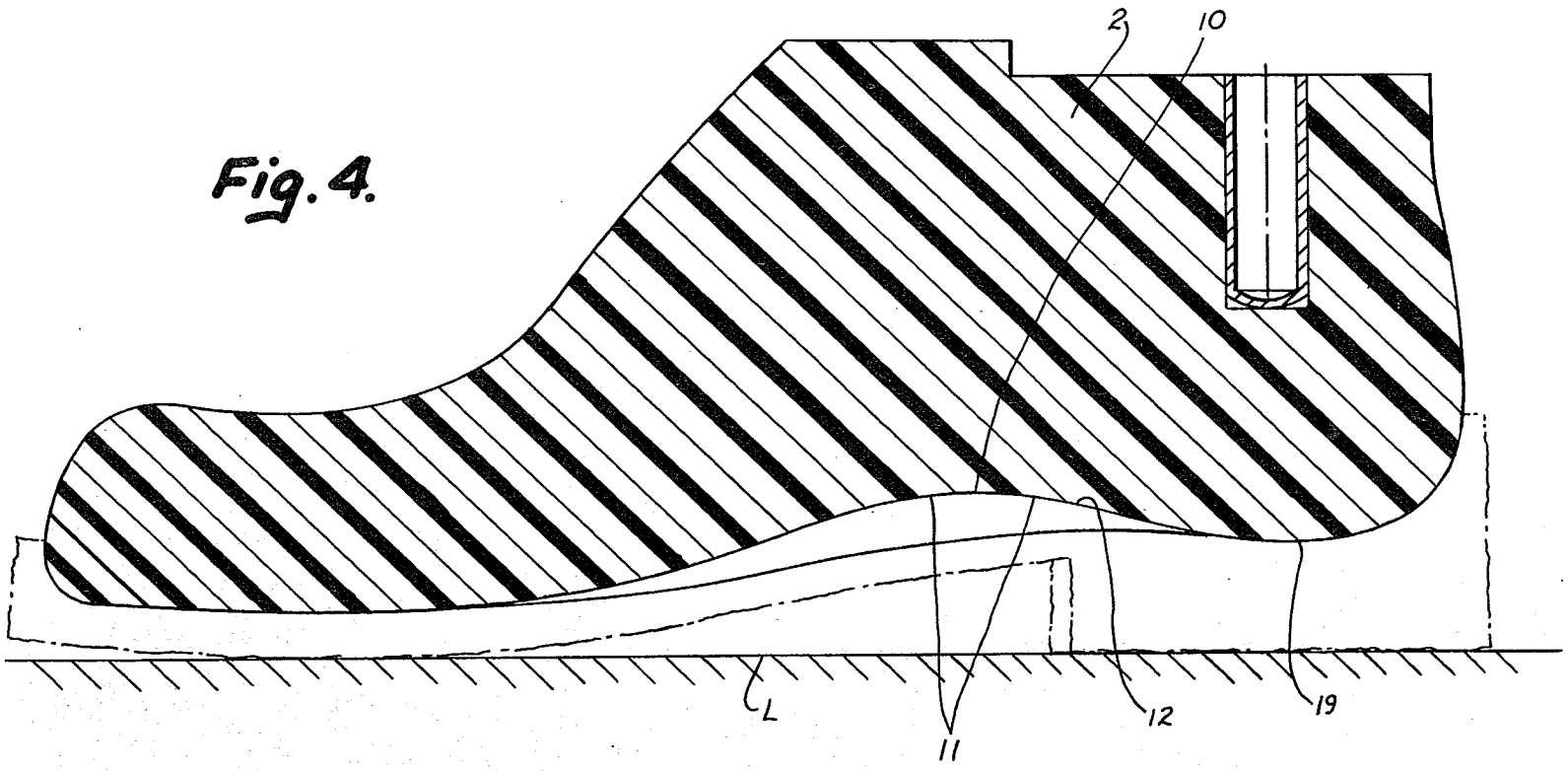
FIG. 4 is a longitudinal section through the last.
Figure 5:
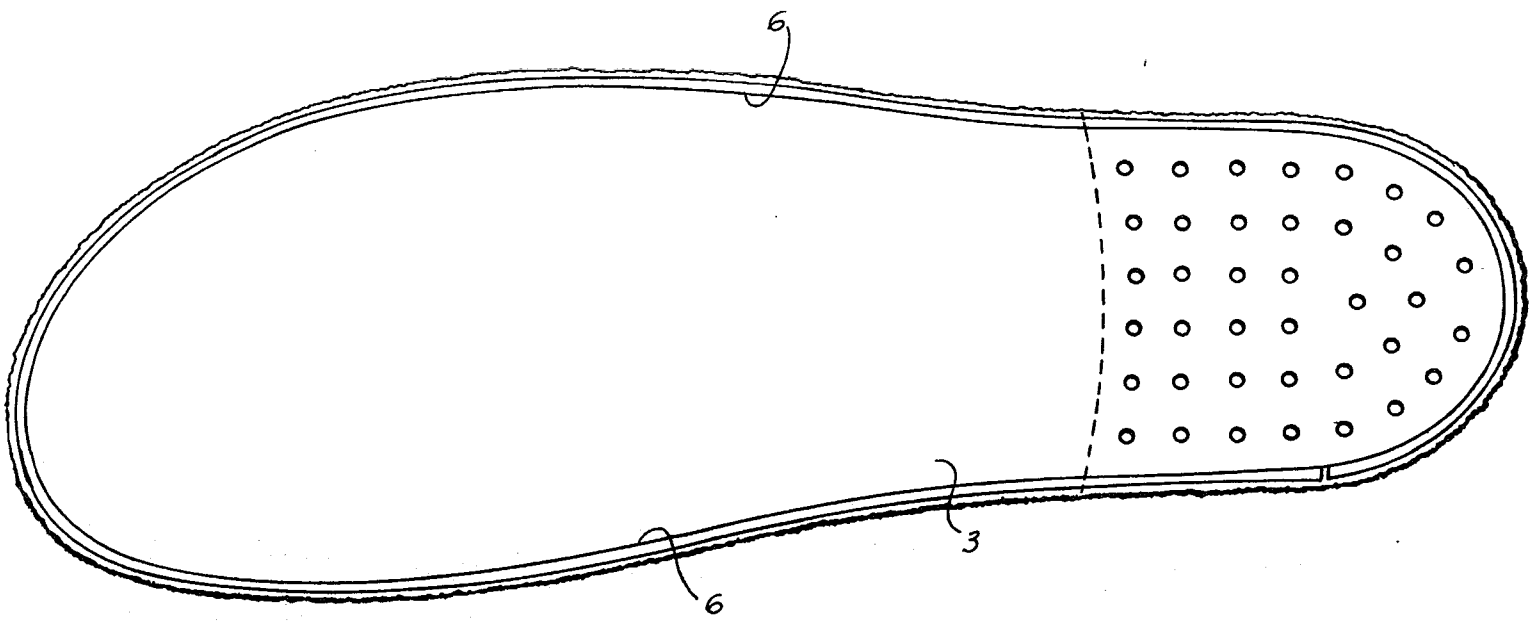
FIG. 5 is a plan view from above of the lower part of the shoe.
Figure 6:
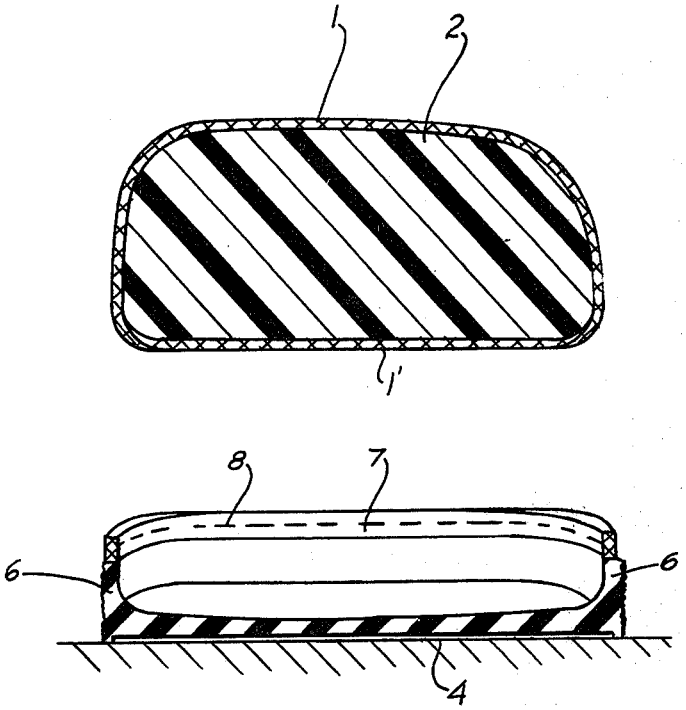
FIG. 6 is a section along the lines a–b in FIGS. 2 and 3.
Figure 7:
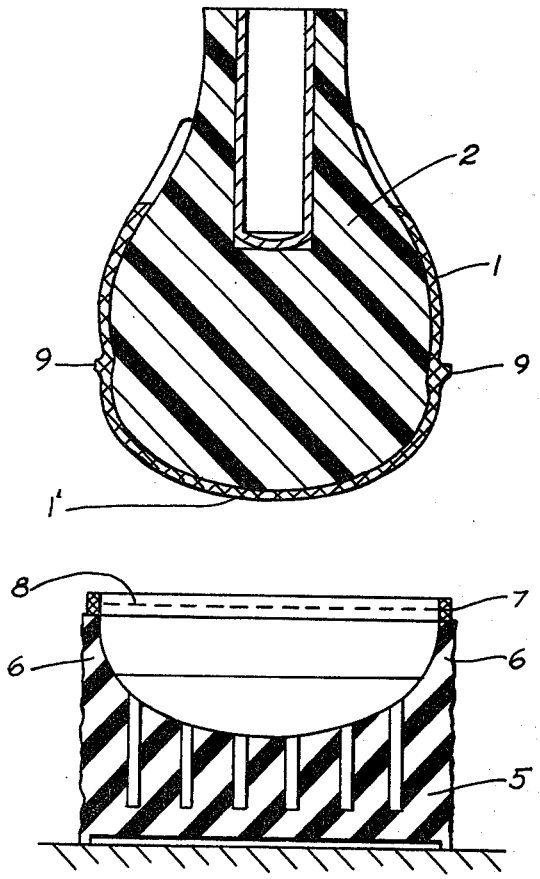
FIG. 7 is a section along the lines c–d in FIGS. 3 and 4.

The deepest point 19 (FIG. 4) in the area of the heel of the last lies considerably nearer the running surface L than the highest point 10 of the arching of the joint 11. Thus, a footbed is formed in the shoe that corresponds to the natural shape of the foot and in which the part of the running sole 12, adjacent to the heel, rises in the forward direction, while the joint line of the last descends again about rectilinearly toward the tip of the shoe. Immediately adjacent the surface of the sole is the material 1' replacing the insole of upper part 1 of the shoe. The seams 9, connecting the material cut, provided in the upper part of the shoe, are usually directed outwardly. Lower Part 3 of the shoe, forming running sole 4 and heel 5 is appropriately molded, e.g. cast or injected from an elastic material, usually a polymer such as rubber. It has a cup shape adapted precisely to the shape of the sole of the foot, conforming to the lower part of the last.

The lower part 3 of the shoe has an upwardly directed peripheral edge 6 upon which is seated a terminal or marginal strip 7 made of an inelastic or slightly elastic material, such as leather or the like, which can be eventually provided with a longitudinal seam 8. The edge 6 with strip 7 extends upwardly a sufficient amount such that, after joining upper part 1 with lower part 3 of the shoe, upstanding edge 6 covers outwardly directed seams 9 in the upper part of the shoe. Thus, the finished shoe receives the appearance shown in FIG. 1. Upper part 1 and lower part 3 of the shoe are lastingly interconnected by adhesion. The last 2 is left in the stocking-like upper part 1 until, after putting on the lower part 3 of the shoe, the adhesive has set and the lower part and the upper part of the shoe are orderly interconnected. Only then is the last 2 removed from the upper part of the shoe.

A supporting surface F for the foot is thus formed in the footbed from the deepest point of the deepening at the heel 18 (FIG. 3) rising in the forward direction up to the highest point of the arching of the joint and oriented relative to the running surface L at an angle a rising in the forward direction. The outer form of embodiment of the upper part of the shoe is naturally discretionary and adapted to the purpose and fashions at the time.

The embodiments of the invention in which an exclusive property or privilege is claimed are defined as follows:

1. A shoe of natural shape having a flexible material forming the upper part of the shoe, replacing the insole, and extending all over the sole surface, to comprise a stocking-like part which extends over the last to envelop the foot on all sides and having a footbed, characterized by that a recess is formed for the reception of the heel in the area of the heel of said footbed; said footbed having a bearing surface for the foot, rising from said recess of the heel toward the arching of the joint formed into a cup-shaped lower part of the shoe, being adapted to the shape of the sole of the foot, forming a running sole and heel and having a lower part which emcompasses said stocking-like part with an upstanding peripheral edge and lastingly connected with said upper part of the shoe; and said upper part having outwardly directed seams, and said upstanding peripheral edge covers said seams.

2. The shoe of natural shape according to claim 5, characterized by a terminal strip adjacent said upper part of the shoe and seated on said upstanding peripheral edge.

3. The shoe of natural shape according to claim 2, characterized by that the cup-shaped lower part of the shoe is molded and said strip is pulled together into the molded part.

4. The shoe of natural shape according to claim 2, characterized by that said strip is provided with a longitudinal seam.

5. The shoe of natural shape according to claim 1, characterized by that said running sole and heel are formed of an elastic material and said strip is formed of a nonelastic or slightly elastic material.

* * * * *

UNITED STATES PATENT AND TRADEMARK OFFICE

CERTIFICATE OF CORRECTION

PATENT NO. : 4,306,361

DATED : December 22, 1981

INVENTOR(S) : Paul Kaschura

It is certified that error appears in the above—identified patent and that said Letters Patent is hereby corrected as shown below:

Column 1, line 27:

"in vention" should be ---invention---

Column 2, line 25:

"Part" should be ---part---

Column 3, line 9, claim 2:

"5" should be ---1---

Signed and Sealed this

Fourth Day of May 1982

[SEAL]

*Attest:*

GERALD J. MOSSINGHOFF

*Attesting Officer*

*Commissioner of Patents and Trademarks*